US012446680B2

(12) United States Patent
Chia et al.

(10) Patent No.: US 12,446,680 B2
(45) Date of Patent: Oct. 21, 2025

(54) WRAP DEVICE FOR MODULAR PANEL SYSTEM AND WRAPPING METHOD

(71) Applicant: Honda Motor Co., Ltd., Tokyo (JP)

(72) Inventors: Geemay Chia, Pasadena, CA (US); Satoshi Hayashi, Wako (JP); So Nakaura, Wako (JP); Ju-Chia Lee, Pasadena, CA (US)

(73) Assignee: Honda Motor Co., Ltd., Tokyo (JP)

( * ) Notice: Subject to any disclaimer, the term of this patent is extended or adjusted under 35 U.S.C. 154(b) by 153 days.

(21) Appl. No.: 18/181,190

(22) Filed: Mar. 9, 2023

(65) Prior Publication Data

US 2024/0298784 A1 Sep. 12, 2024

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01)

(58) Field of Classification Search
CPC ..... A45F 3/04; A45F 2003/003; A45F 3/14; A45F 2005/1006; A45C 2007/0013; A45C 7/007
USPC ..... 224/578–579
See application file for complete search history.

(56) References Cited

U.S. PATENT DOCUMENTS 299,670 A 6/1884 Nash
2,964,173 A * 12/1960 Schnabel ..... B65D 25/22 229/117.23
3,346,155 A * 10/1967 Oechsle ..... A45F 5/12 150/108
3,913,289 A 10/1975 Recker
3,917,102 A 11/1975 Repetti
4,188,067 A * 2/1980 Elmer ..... A47C 4/021 297/440.13
4,441,756 A 4/1984 Liou et al.
4,489,815 A * 12/1984 Martinez ..... A45F 4/02 229/189
4,687,248 A 8/1987 Ross et al.
4,784,436 A 11/1988 Sutherland
4,811,437 A * 3/1989 Dillner ..... A47D 13/063 5/99.1
4,984,906 A 1/1991 Little
5,150,501 A 9/1992 Pasternak
(Continued)

FOREIGN PATENT DOCUMENTS

CA 2877240 C 5/2022
CN 4003704 A1 8/1991
(Continued)

OTHER PUBLICATIONS

Office Action of U.S. Appl. No. 18/181,153 dated Feb. 24, 2025, 23 pages.

(Continued)

*Primary Examiner* — Adam J Waggenspack
(74) *Attorney, Agent, or Firm* — Rankin, Hill & Clark LLP

(57) ABSTRACT

A wrap device and wrapping for a modular panel system includes a flexible wrap material adapted to securely wrap stacked panels of the modular panel system for securing and carrying the panels. The flexible wrap material member includes at least two strap attachment features and at least one strap adapted to selectively couple to the at least two strap attachment features.

20 Claims, 4 Drawing Sheets

(56) References Cited

U.S. PATENT DOCUMENTS 5,251,945 A * 10/1993 Stoops ..... A45C 7/0095 D34/28
5,251,956 A * 10/1993 Hofmeyer ..... A47C 7/68 297/173
5,582,458 A 12/1996 Wildt
5,588,696 A 12/1996 Jay et al.
5,709,155 A 1/1998 Terracciano
5,863,088 A * 1/1999 Kelly, Sr. ..... A45F 4/02 294/146
6,068,355 A 5/2000 Thorp
6,557,955 B2 5/2003 Saravis
6,705,338 B2 3/2004 Zheng
6,843,529 B2 1/2005 Ballendat
7,048,333 B2 * 5/2006 Martinez ..... A47C 7/66 135/96
7,213,356 B2 5/2007 Haggard, Jr.
7,963,404 B2 6/2011 Shang
8,082,971 B1 12/2011 Peterson et al.
8,312,596 B2 11/2012 Self
8,387,676 B2 3/2013 Hunckler et al.
8,449,026 B1 5/2013 Gutierrez et al.
8,782,853 B2 7/2014 Ge
8,938,855 B2 1/2015 Ahn et al.
8,955,928 B2 2/2015 Cheng
9,226,576 B2 1/2016 Shang et al.
9,441,358 B2 9/2016 Harman et al.
9,445,666 B2 9/2016 Chang
9,516,947 B2 12/2016 Taylor
9,527,626 B1 12/2016 Coronado
9,714,533 B2 7/2017 Kuramochi
9,879,471 B2 1/2018 Lewis et al.
9,915,086 B2 3/2018 Kato
10,064,466 B2 9/2018 Fulton et al.
10,202,735 B2 2/2019 Heselden
10,531,740 B2 1/2020 Graybill
10,561,215 B1 2/2020 Klein
10,720,085 B2 7/2020 Lorenzo
10,880,416 B2 12/2020 Li et al.
11,160,376 B2 11/2021 Gass
11,193,299 B2 12/2021 Andre et al.
11,234,526 B1 2/2022 Levin
11,234,527 B2 2/2022 Besner et al.
11,317,600 B2 5/2022 Huthmaker et al.
11,382,404 B2 7/2022 Davies
2003/0172493 A1 9/2003 Christiansen et al.
2004/0182900 A1 * 9/2004 Brown ..... A45C 13/103 224/579
2005/0122671 A1 6/2005 Homer
2005/0236450 A1 * 10/2005 Iannini ..... A45F 3/15 224/577
2007/0057542 A1 3/2007 Rush
2007/0176462 A1 8/2007 Lombardo
2009/0108968 A1 4/2009 Tsai et al.
2009/0121534 A1 5/2009 Brauning
2010/0306917 A1 * 12/2010 Batiste ..... A47G 27/0237 5/420
2012/0317719 A1 * 12/2012 Ng ..... A63B 21/4037 5/417
2013/0011181 A1 1/2013 Riedmueller
2014/0021749 A1 1/2014 Roani et al.
2014/0069970 A1 * 3/2014 Thomas, Jr. ..... A45C 13/26 224/257
2014/0368986 A1 12/2014 Lin
2015/0102080 A1 * 4/2015 Bullock ..... A45C 7/0095 224/577
2015/0125235 A1 5/2015 Benthien et al.
2018/0142718 A1 5/2018 Zhu
2021/0235828 A1 8/2021 Yeh
2022/0022654 A1 1/2022 Fraser
2022/0113771 A1 4/2022 Wu et al.
2022/0412140 A1 12/2022 Young et al.
2023/0323733 A1 10/2023 Gibbs, Jr. et al.
2024/0301901 A1 9/2024 Dressel et al.
2024/0301902 A1 9/2024 Hayashi et al.

FOREIGN PATENT DOCUMENTS

CN 2817601 Y 9/2006
CN 203926360 U 11/2014
CN 209548670 U 10/2019
CN 210799708 U 6/2020
CN 213154911 U 5/2021
CN 111043149 B 9/2021
CN 112392850 B 3/2022
CN 216797153 U 6/2022
DE 202006001105 U1 5/2006
EP 2532275 B1 4/2014
EP 3987976 A1 4/2022
GB 2413056 A 10/2005
GB 2598425 A 3/2022
WO WO9009749 A1 9/1990
WO WO2010046521 A1 4/2010
WO WO2013132355 A3 12/2013
WO WO2019150165 A1 8/2019

OTHER PUBLICATIONS

Notice of Allowance of U.S. Appl. No. 18/181,153 dated Jun. 3, 2025, 10 pages.
Office Action of U.S. Appl. No. 18/181,156 dated Jun. 16, 2025, 43 pages.
Office Action of U.S. Appl. No. 18/390,376 dated Jul. 1, 2025, 39 pages.

* cited by examiner

WRAP DEVICE FOR MODULAR PANEL SYSTEM AND WRAPPING METHOD

BACKGROUND

A variety of collapsible panel systems are known. Also a variety of collapsible furniture structures are known. Nonetheless, there remains a need for easily transportable collapsible structures, including panel systems that are collapsible and configurable into various useful structures, such as furniture, as well as for components for such systems. In particular, disadvantages of known collapsible furniture and panel systems include the following: difficult to assemble and disassemble, difficult to transport, configurable in only a limited configuration or a few configurations, etc.

BRIEF DESCRIPTION

According to one aspect, a wrap device for a modular panel system includes a flexible wrap material adapted to selectively wrap stacked panels of the modular panel system for securing and carrying the panels. The flexible wrap material member includes at least two strap attachment features and at least one strap adapted to selectively couple to the at least two strap attachment features.

According to another aspect, a wrap device in combination with a modular panel system includes first and second panel members adapted to be removably connected together to form a predefined assembly in an assembled state or stacked together for transport in a stacked state. The wrap device in combination with the modular panel system further includes a flexible wrap material member configured to selectively wrap the stacked panels when in the stacked configuration and includes at least one strap. The flexible wrap material member includes at least two strap attachment features. The at least one strap is adapted to selectively connect to the at least two strap attachment features of a flexible wrap material member.

According to a further aspect, a wrapping method for a wrap device of a modular panel system includes providing first and second panel members adapted to be removably connected together to form a predefined assembly in an assembled state or stacked together for transport in a stacked configuration and providing a flexible wrap material member configured to selectively wrap the stacked panels when in the stacked configuration. The method further includes stacking the first and second panel members into the stacked configuration and wrapping the flexible material member around the first and second panels in the stacked configuration. The flexible wrap material member is wrapped about lateral sides of the first and second panels.

DETAILED DESCRIPTION

It should, of course, be understood that the description and drawings herein are merely illustrative and that various modifications and changes can be made in the structures disclosed without departing from the present disclosure. Spatially relative terms may be used to describe an element and/or features relationship to another element(s) and/or feature(s) as, for example, illustrated in the figures. Moreover, any term of degree used herein, such as "substantially" and "approximately", means a reasonable amount of deviation of the modified word is contemplated such that the end result is not significantly changed.

Figure 1:
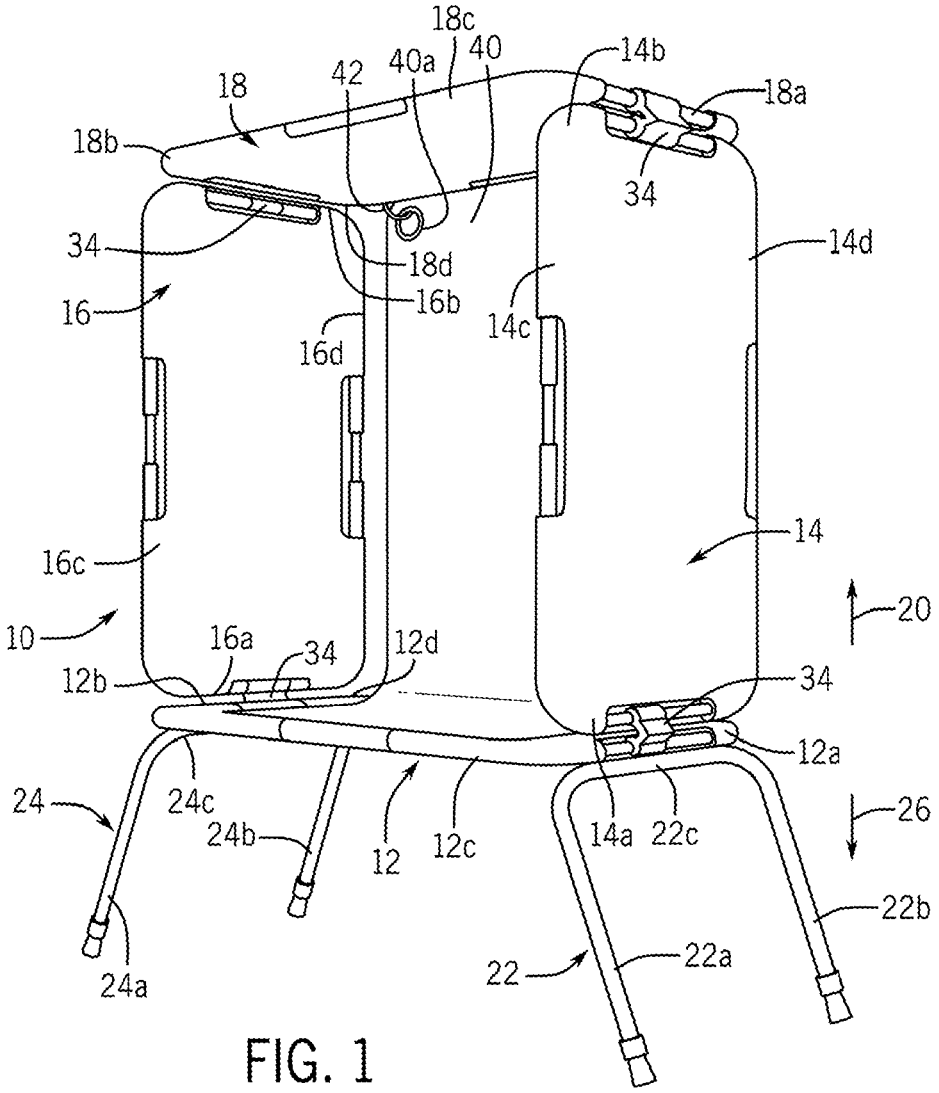
FIG. 1 is a schematic perspective view of a modular panel system shown in an assembled state in a shade chair configuration according to one aspect of the present disclosure.

Referring now to the drawings, wherein like numerals refer to like parts throughout the several views, FIG. 1 illustrates a modular panel system 10 according to one embodiment of the present disclosure. More particularly, the modular panel system 10 of the illustrated embodiment is shown in an assembled state and particularly in a shade chair configuration. The modular panel system 10 of the illustrated embodiment includes a first panel 12, a second panel 14, a third panel 16, and a fourth panel 18. The second panel 14 is removably connected to the first panel 12 at a lower end thereof (i.e., at end edge portion 14*a*) and likewise the third panel 16 is removably connected to the first panel 12 at a lower end thereof (i.e., end edge portion 16*a*) but in laterally spaced relation relative to the second panel 14. The fourth panel 18 is removably connected to the second and third panels 14, 16 at respective upper ends thereof (i.e., end edge portions 14*b* and 16*b*) in spaced relation relative to the first panel 12.

As shown, in the assembled state in the shade chair configuration, the first panel 12 provides an elevated seating platform, such as for a person (not shown) to sit. The other panels 14, 16, 18 provide at least one of shade, privacy or an enclosure effect to the first panel 12. The modular panel system 10 of the illustrated embodiment is shown including four panels, i.e., panels 12, 14, 16, 18. However, it is to be understood by those skilled in the art that fewer than four panels could be included or more than four panels could be included as part of the modular panel system 10 and these could provide other configurations in the assembled state than the illustrated shade chair.

More particularly, each of the panels 12, 14, 16, 18 includes edge portions, particularly including end edge portions (e.g., end edge portions 12*a*, 12*b*, 14*a*, 14*b*, 16*a*, 16*b*, 18*a*, 18*b*) spaced apart from one another to define a panel length for a particular panel and lateral edge portions (e.g., lateral edge portions 12*c*, 12*d*, 14*c*, 14*d*, 16*c*, 16*d*, 18*c*, 18*d*) spaced apart from one another to define a width for the particular panel with each lateral edge portion extending from one of the end edge portions to the other of the end edge portions of a particular panel. In one embodiment, each of the panels 12, 14, 16, 18 can be identical to one another, though this is not required. Specifically, the first panel 12 can include edge portions 12*a*, 12*b*, 12*c* and 12*d* that include end edge portions 12*a*, 12*b* spaced apart from one another to define a panel length for the first panel 12 (i.e., first panel length), and lateral edge portions 12*c*, 12*d* spaced apart from one another to define a panel width for the first panel 12 (i.e., first panel width) with each of the lateral edge portions 12*c*, 12*d* extending from one of the end edge portions 12*a* or 12*b* (e.g., end edge portion 12*a*) to the other of the end edge portions 12*a* or 12*b* (e.g., end edge portion 12*b*).

In the illustrated embodiment, the second panel 14 can be the same as the first panel 12. Accordingly, the second panel 14 can likewise include end edge portions 14*a*, 14*b*, 14*c*, 14*d*, including end edge portions 14*a*, 14*b* spaced apart from one another to define a panel length of the second panel 14 (i.e., second panel length), and lateral edge portions 14*c*, 14*d* spaced apart from one another to define a panel width of the second panel 14 (i.e., second panel width) with each of the lateral edge portions 14*c*, 14*d* extending from one of the end edge portions 14*a* or 14*b* (e.g., end edge portion 14*a*) to the other of the end edge portions 14*a* or 14*b* (e.g., end edge portion 14*b*). Since the panels 12 and 14 are identical to one another in the illustrated embodiment, the second panel length and second panel width of the second panel 14 are, respectfully, the same as the first panel length and the first panel width of the first panel 12. As will be described in more detail below, the first and second panels 12, 14 are configured to be removably coupled to one another (e.g., by the coupling device 34) by having respective edge portions, particularly edge portions 12*a* and 14*a* of each of the first and second panels 12, 14, arranged longitudinally adjacent to one another and removably coupled together. This removable coupling can be enabled by a removable coupling device or member, such as coupling device 34.

In one embodiment, the removable coupling device 34 is one of the coupling devices described in commonly owned U.S. Patent Application Ser. No. 18/181,156, entitled "MODULAR PANEL SYSTEM, KIT, AND METHOD" that is filed concurrent with the subject application on Mar. 9, 2023, and is expressly incorporated herein in its entirety by reference. In other embodiments, the coupling device 34 is one of the coupling devices described in commonly owned U.S. Patent Application Ser. Nos. 18/181,136, entitled "REMOVABLE COUPLING DEVICE AND METHOD FOR COUPLING PANELS" that is filed concurrent with the subject application on Mar. 9, 2023, or commonly owned U.S. Patent Application Ser. Nos. 18/181,153, entitled "COUPLING DEVICE AND METHOD FOR COUPLING PANELS" that is filed concurrent with the subject application on Mar. 9, 2023, both expressly incorporated herein in its entirety by reference.

As already mentioned, the third and fourth panels 16, 18 can also be identical to the first panel 12. Accordingly, each of these panels 16, 18 includes edge portions, including end edge portions (end edge portions 16*a*, 16*b* for the third panel 16 and end edge portions 18*a*, 18*b* for the fourth panel 18) spaced apart from one another to define a panel length, and lateral edge portions (lateral edge portions 16*c*, 16*d* for the third panel 16 and lateral edge portions 18*c*, 18*d* for the fourth panel 18) spaced apart from one another to define a panel width with each of the lateral edge portions extending from one of the end edge portions to the other of the end edge portions. The third panel 16 and the fourth panel 18 are each configured to be removably coupled to the other panels 12, 14, 16, 18 by additional coupling devices 34. For example, in FIG. 1, end edge portion 16*a* of the third panel 16 is arranged longitudinally adjacent the end edge portion 12*b* and removably coupled thereto by a second coupling device 34. End edge portion 16*b* of the third panel 16 is arranged longitudinally adjacent the end edge portion 18*b* of the fourth panel 18 and removably coupled thereto by a further coupling device 34. End edge portion 14*b* is arranged longitudinally adjacent the end edge portion 18*a* of the fourth panel and removably coupled thereto by still another coupling device 34.

Since the third panel 16 is the same as the first and second panels 12, 14, the panel length and panel width of the third panel 16 are, respectively, the same as the panel length and panel width of the first panel 12 and the second panel 14. Similarly, since the fourth panel is the same in size and shape as the first, second, and third panels 12, 14, 16, the panel length and panel width of the fourth panel 18 are, respectively, the same as the panel length and panel width of each of the first panel 12, the second panel 14, and the third panel 16.

In the assembled configuration of FIG. 1, the first, second, third, and fourth panels 12, 14, 16, 18 are specifically orthogonally arranged to form a rectangular structure or configuration, which can be referred to as a shade chair configuration as mentioned above. In particular, the end edge portions of the first, second, third, and fourth panels 12, 14, 16, 18 are secured to one another by the coupling devices 34 such that the second and third panels, 14, 16 are spaced apart from one another and are secured to both the first and fourth panels 12, 18 with the first and fourth panels 12, 18 spaced apart from one another. In particular, the second and third panels 14, 16 extend in a first direction illustrated by arrow 20 away from the first panel 12.

In addition, as shown, the modular panel system 10 can include at least one leg attachment member, such as the illustrated leg attachment members 22, 24. In particular, in the illustrated embodiment, the at least one leg attachment member includes two leg attachment members 22, 24. Each of these leg attachment members 22, 24 is removably secured to the first panel 12 at the end edge portions 12*a*, 12*b* and extends substantially in a second direction illustrated by arrow 26 away from the first panel 12 that is opposite the first direction represented by arrow 20. As shown, the first leg attachment member 22 can be removably secured to a first one of the end edge portions of the first panel 12, namely the end edge portion 12*a*, and the second leg attachment member 24 can be secured to a second one of the end edge portions of the first panel 12, namely the end edge portion 12*b* that is opposite the first end edge portion 12*a*.

The leg attachment members 22, 24 in the illustrated embodiment are each formed as a U-shaped structure. Accordingly, the first leg attachment member 22 includes leg portions 22*a*, 22*b* connected together by an attachment portion 22*c*. The attachment portion 22*c* is removably coupled to the end edge portion 12*a*. Likewise, the second leg attachment member 24 can include leg portions 24*a*, 24*b* and an attachment portion 24*c* removably coupled to the end edge portion 12*b*. The attachment portions 22*c*, 24*c* can be removably coupled to the respective end edge portions 12*a*, 12*b* of the first panel 12 through any known removable connection as will be understood and appreciated by those skilled in the art. For example, the leg attachment portions 22*c*, 24*c* can include a snap-fit removable coupling, a screw-type coupling, a cam-lock type coupling, etc. (none of which are shown). Additionally, the leg attachment members 22, 24, and particularly the leg portions 22*a*, 22*b*, 24*a*, 24*b* thereof can be or include telescoping legs so as to be height adjustable. In the assembled state and configuration of FIG. 1 (i.e., the shade chair configuration), adjusting the telescoping height of the leg portions 22*a*, 22*b*, 24*a*, 24*b* can selectively raise and lower a desired height of the panels 12, 14, 16, 18 as might be advantageous when choosing a height for the first panel 12 on which to sit.

Figure 2:
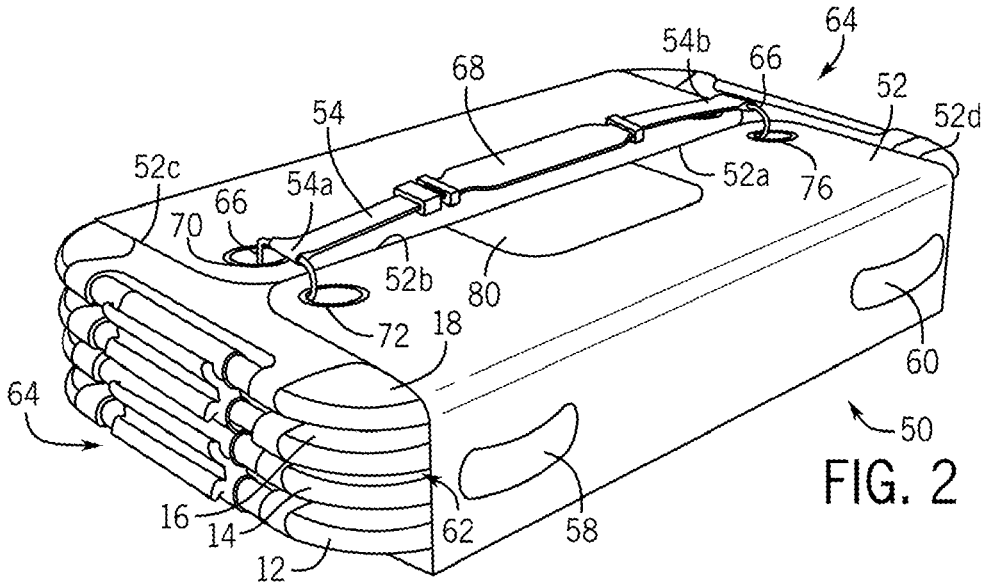
FIG. 2 is a schematic perspective view of a modular panel system shown in a disassembled state in a stacked configuration with a wrap device wrapping panels of the modular panel system for transport and/or carrying according to one aspect of the present disclosure.

With additional reference to FIGS. 2 and 3, the modular panel system 10 can additionally include a wrap device or kit 50. In one embodiment, the wrap device 50 is provided in combination with the modular panel system 10. In particular, the illustrated embodiment, the wrap device 50 includes a flexible wrap material member 52 adapted to selectively wrap stacked panels, such as panels 12, 14, 16, 18, of the modular panel system 10 for securing and carrying the stacked panels 12, 14, 16, 18. In particular, the flexible wrap material member 52 is configured to selectively wrap the stacked panels 12, 14, 16, 18 when the panels 12, 14, 16, 18 are in a disassembled state and are in the stacked configuration for transport thereof as shown in FIG. 2. As will be described in more detail below, the flexible wrap material member 52 can include at least two strap attachment features (e.g., attachment features 58, 60, 70, 72, 74, 76 in the illustrated embodiment) and the wrap device 50 can include at least one strap (e.g., straps 54 and 56) adapted to selectively couple or connect to the at least two strap attachment features of the flexible wrap material member 52. In one embodiment, the at least one strap is a pair of straps 54, 56 having matching longitudinal lengths though this is not required.

Figure 3A:
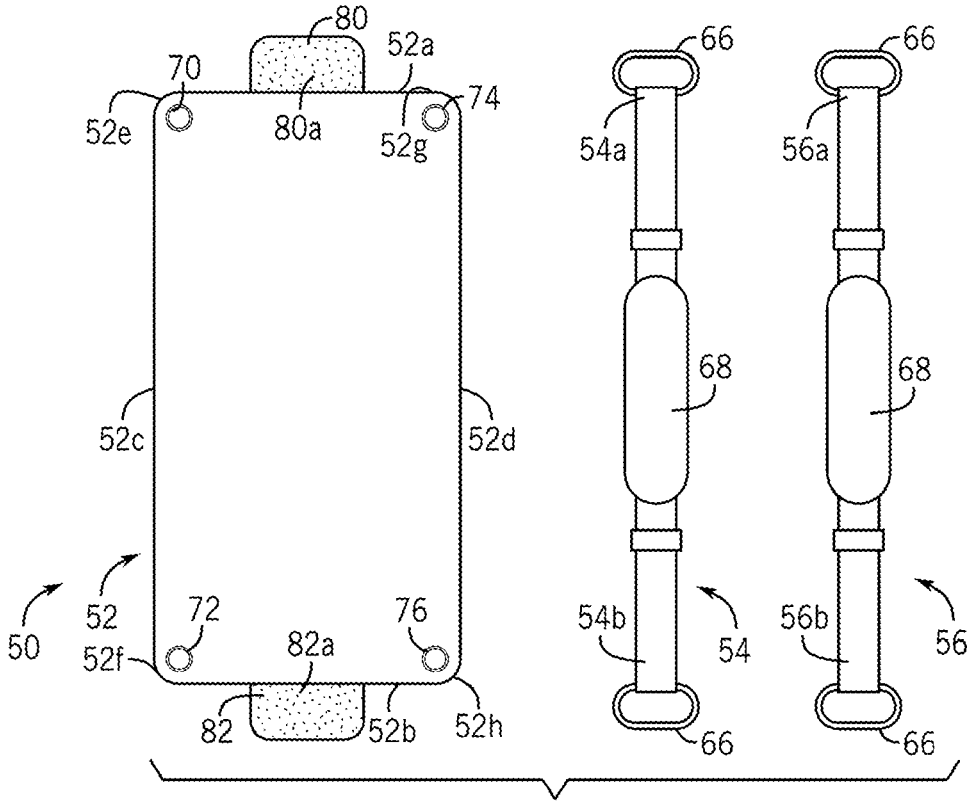
FIG. 3A Is a plan view of the wrap device shown including a flexible wrap material member and pair of straps according to one aspect of the present disclosure.
Figure 3B:
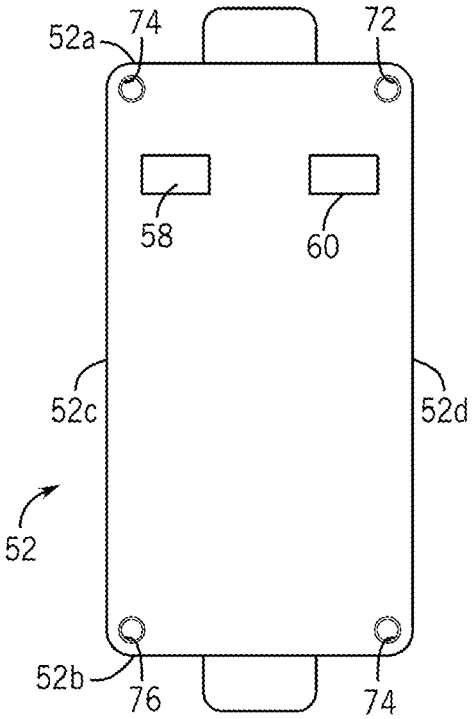
FIG. 3B is a plan view of the flexible wrap material member showing a reverse side thereof relative to FIG. 3A.

More particularly, in one embodiment, the at least two strap attachment features can include first and second loop members 58, 60 disposed on the flexible wrap material member 52. In one embodiment, the loop member 58, 60 are made of the same material as the flexible wrap material member 52. As shown, the first and second loop members 58, 60 can be spaced apart asymmetrically from longitudinal ends 52*a*, 52*b* of the flexible wrap material member 52. In particular, the loop members 58, 60 can be positioned more closely relative to the longitudinal end 52*a* than relative to the longitudinal end 52*b* as best shown in FIG. 3B. Also, the loop members 58, 60 can be positioned closely adjacent lateral ends or sides 52*c*, 52*d* of the flexible wrap material member 52 as also shown in FIG. 3B. In particular, the loop members 58, 60 can be positioned close to the lateral sides 52*c*, 52*d* of the flexible wrap material member 52 while being spaced apart from one another as far as possible.

Figure 4:
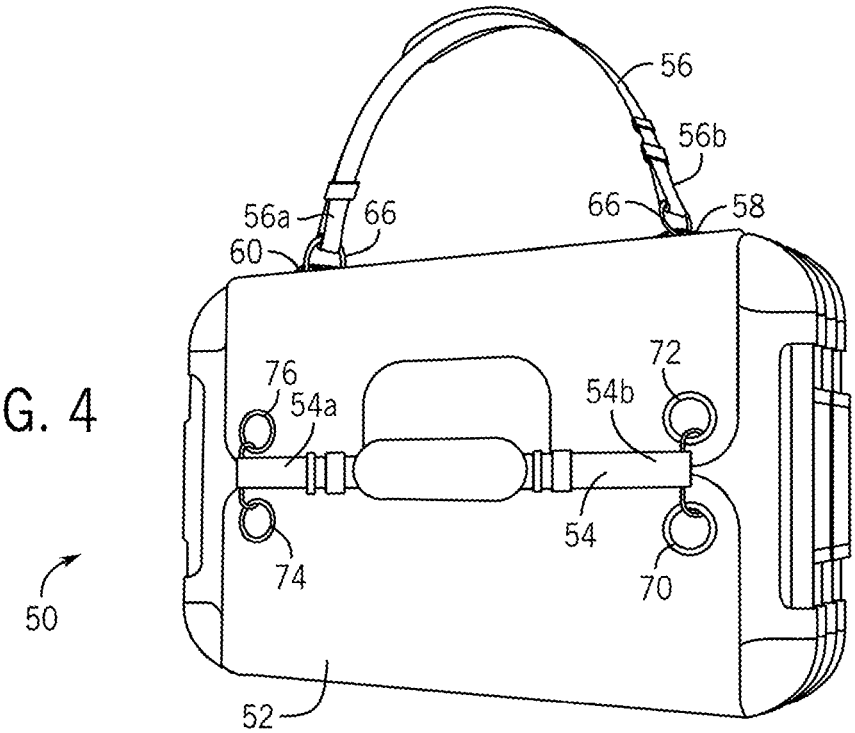
FIG. 4 is a perspective view similar to FIG. 2 but showing a second strap secured to the flexible wrap material member for carrying in a vertical orientation.

Accordingly, and as best shown in FIG. 2, such positioning of the loop members allows the loop members 58, 60 to be positioned along one set of lateral ends 62 of the stacked panels 12, 14, 16, 18 (e.g., lateral edge portions 12*c*, 14*c*, 16*c*, 18*c*) in contrast to a top side or bottom side of the stacked panels 12, 14, 16, 18 when the flexible wrap material member 52 is in a wrapped configuration (i.e., the configuration shown in FIG. 2) about the stacked panels 12, 14, 16, 18. Also as shown, the longitudinal ends 64 of the panels 12, 14, 16, 18 are exposed (i.e., not wrapped0 by the flexible wrap material member 52. As shown in FIG. 4, the at least one strap, for example the second strap 56, can be adapted to have distal ends 56*a*, 56*b* thereof secured respectively to the first and second loop members 58, 60 for carrying the stacked panels 12, 14, 16, 18 via the at least one strap, i.e., second strap 56.

In particular, the first and second loop members 58, 60 can be disposed on the flexible wrap material member 52 to which distal ends 56*a*, 56*b* of the second strap 56 are removably connectable for carrying the panel members 12, 14, 16, 18 in the stacked configuration when the flexible wrap material member 52 is selectively wrapped about the panels 12, 14, 16, 18. In one embodiment, each of the first and second straps 54, 56 includes a latching device 66 at each of the distal ends (distal ends 56*a*, 56*b* of the second strap 56 and distal ends 54*a*, 54*b* of the first strap 54) for removably connecting the respective strap, such as the second strap 56, to the first and second loop members 58, 60. In one embodiment, the latching device 66 is a carabiner. In other embodiments, other fasteners or connecting devices can be used in place of the carabiner 66. Additionally, as will be understood by those skilled in the art, each of the first and second strap 54, 56 can include a movable shoulder pad 68 and/or each of the first and second straps 54, 56 can be adjustable in length.

Figure 5:
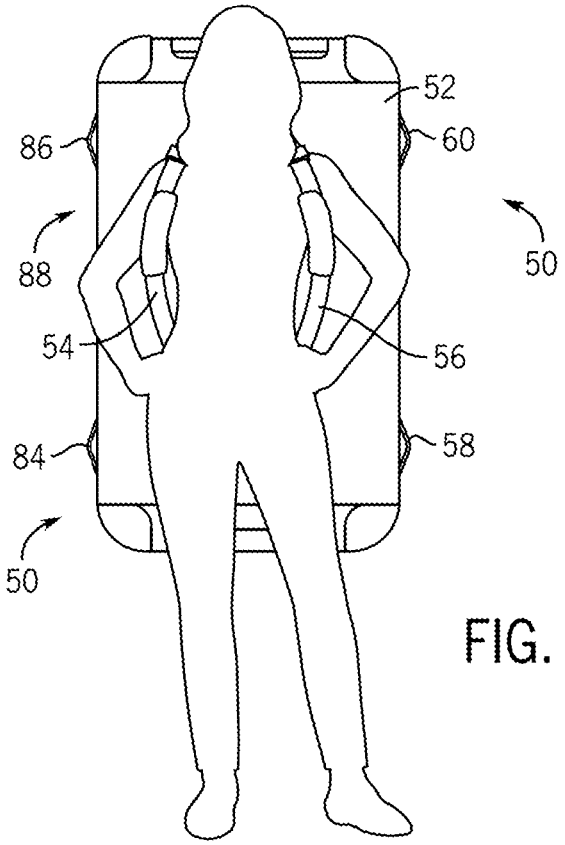
FIG. 5 is a schematic view of the modular panel system shown in the disassembled state in the stacked configuration wherein two straps are deployed for carrying the modular panel system as a backpack.

Optionally, and as shown in FIG. 5, a second set of loop members 84, 86 can be provided on the flexible wrap material member 52. These can be the same as the loop members 56, 58 but disposed on the flexible wrap material member so as to be positioned adjacent opposite lateral ends 88 of the panels 12, 14, 16, 18 relative to the lateral ends 62.

In the same or another embodiment, the at least two strap attachment features can include eyelet apertures 70, 72, 74, 76 disposed respectively at each corner 52*e*, 52*f*, 52*g*, 52*h* of the flexible wrap material member 52. These attachment features can be in addition or in the alternative to the loop members 58, 60. In the illustrated embodiment, the eyelet apertures 70, 72, 74, 76 are in addition to the loop members 58, 60. The latching devices, such as carabiners 66, of the straps 54, 56 disposed at distal ends 54*a*, 54*b* of the first strap 54 and 56*a*, 56*b* of the second strap 56 are provided for selectively securing to the eyelet apertures 70, 72, 74, 76, or more particular to the flexible wrap material member 52 disposed adjacent the eyelet aperture 70, 72, 74, 76 at the corners 52*e*, 52*f*, 52*g*, 52*h* of the flexible wrap material member 52.

As shown in FIG. 2, the eyelet apertures 70, 72 disposed at the longitudinal end 52*a* of the flexible wrap material member 52 can be adjacently positioned next to the eyelet apertures 74, 76 of the longitudinal end 52*b* of the flexible wrap material member 52 when the flexible wrap material member 52 is wrapped about the stacked panels 12, 14, 16, 18. When so arranged with the eyelet apertures 70, 72, 74, 76 arranged adjacent one another, the first strap 54 can have its distal ends 54*a*, 54*b* secured to the eyelet apertures 70, 72, 74, 76 via the latching devices 66 for both securing the flexible wrap material member 52 in the wrapped configuration about the stacked panels 12, 14, 16, 18 and/or for providing an easy means for carrying the stacked panels 12, 14, 16, 18. More particularly, the carabiner 66 at the distal end 54*a* of the first strap 54 can be connected to adjacent eyelet apertures 70, 72 and the carabiner 66 at the distal end 54*b* of the first strap 54 can be secured to the eyelet apertures 74, 76 disposed adjacent the longitudinal end 52*b* of the flexible wrap material member 52 as shown in FIG. 2. More particularly, the distal ends 54*a*, 54*b* of the first strap 54 are removably connectable to the adjacent ones of the eyelet apertures (i.e., adjacent ones being eyelet apertures 70, 72 for the distal end 54*a* and adjacent ones being the eyelet apertures 74, 76 for the distal end 54*b*) when the flexible wrap material member 52 is wrapped about the panels 12, 14, 16, 18 in the stacked configuration so as to extend along a longitudinal extent of the panels 12, 14, 16, 18, as shown in FIG. 2.

As shown in FIG. 4, when the strap attachment features include both the loop members 58, 60 and the eyelet apertures 70, 72, 74, 76, the first strap 54 can be secured to the eyelet aperture 70, 72, 74, 76 as described above and the second strap 56 can be secured to the loop members 58, 60 as described above. Alternatively, both straps 54, 56 can have respective distal ends (distal ends 54*a*, 54*b* of the first strap 54 and distal ends 56*a*, 56*b* of the second strap 56)

secured to adjacent ones of the eyelet aperture 70, 72 and 74, 76. With both straps 54, 56 secured in this manner, the stacked panels 12, 14, 16, 18 can be carried via the straps 54, 56 in a backpack configuration as shown in FIG. 5. Alternatively, the straps 54, 56 can be used to carry the stacked panels 12, 14, 16, 18 similar to how one would carry a suitcase or the straps 54, 56 could be used to attach the stacked panels 12, 14, 16, 18 to another carrying structure, such as a bicycle or roof rack on a vehicle, or some other structure on a vehicle.

Additionally, the flexible wrap material member 52 includes a securing device (e.g., securing devices 80, 82) on at least one of the longitudinal ends 52*a*, 52*b* thereof for securing flexible wrap material member 52 in the wrapped configuration about the stacked panels 12, 14, 16, 18 when in the stacked configuration. In one embodiment, as illustrated, the flexible wrap material member 52 includes a pair of securing devices 80, 82 for securing the flexible wrap material member 52 in the wrapped configuration wherein the flexible wrap material member 52 is wrapped around the stack panels 12, 14, 16, 18. In particular, in the illustrated embodiment, the flexible wrap material member 52 includes a first securing device 80 disposed at the longitudinal end 52*a* of the flexible wrap material member 52 and a second securing device 82 disposed at the longitudinal end 52*b* of the flexible wrap material member 52, as best shown in FIG. 3A.

More particularly, each of the securing devices 80 82 can be or include at least one tab extending from the longitudinal end 52*a* of the flexible wrap material member 52. Further the securing devices 80, 82 can each include a securing feature (e.g., hook and loop fastener 80*a*, 82*a*) for securing the flexible wrap material member 52 in the wrapped configuration when wrapped around the stacked panels 12, 14, 16, 18. For example, the first securing device 80 can be formed as a tab extending from the longitudinal end 52*a* of the flexible wrap material member 52 and can include a hook and loop fastener type arrangement 80*a* thereon that engages to the flexible wrap material member 52. Likewise, the second securing device 82 can be formed as a tab extending form the longitudinal end 52*b* of the flexible wrap material member 52 and can include a hook and loop fastener type arrangement 82*a* thereon that engages to the flexible wrap material member 52.

In the illustrated embodiment, a longitudinal length of the flexible wrap material member 52 (i.e., a dimension extending from the longitudinal end 52*a* to the longitudinal end 52*b* of the flexible wrap material member 52) can substantially match a wrapping dimension of the stacked panels 12, 14, 16, 18. In particular, and as shown in FIG. 2, this wrapping dimension of the stacked panels 12, 14, 16, 18 can include a dimension extending around the entire perimeter of the stacked panels 12, 14, 16, 18 such that the longitudinal ends 52*a*, 52*b* of the flexible wrap material member 52 abut one another with the flexible wrap material member 52 tautly wrapped around the stacked panels 12, 14, 16, 18. Alternatively, a small gap can be provided between the longitudinal ends 52*a*, 52*b*, which can be still considered having the flexible wrap material member longitudinal length substantially match the wrapping dimension of the stacked panels 12, 14, 16, 18.

With reference to FIG. 1, a further feature of the flexible wrap material member 52 is that it is removably connectable to lateral sides (e.g., lateral edge portions 12*c* and 18*d*) of the first and fourth panels 12, 18 when the first, second, third, and fourth panels 12, 14, 16, 18 are in the assembled state and the predefined assembly is a shade chair configuration wherein the first and fourth panels 12, 18 are orthogonally oriented relative to the second and third panels 14, 16 in a rectangular configuration as shown in FIG. 1. In this arrangement, flexible wrap material member 52 can be secured via the eyelet apertures 70, 72 and 74, 76 to the first and fourth panels 12, 18. In particular, latching devices, such as the carabiners 66, can connect the eyelet apertures 70 72, 74, 76 to the first and fourth panels 12, 18. Specifically, the eyelet apertures 70 can be secured via the carabiners 66 to the fourth panel 18 and the eyelet apertures 74, 76 can be secured to the first panel 12 such that the flexible wrap material member 52 provides a seating surface and/or a seatback surface as shown in FIG. 1.

Figure 6:
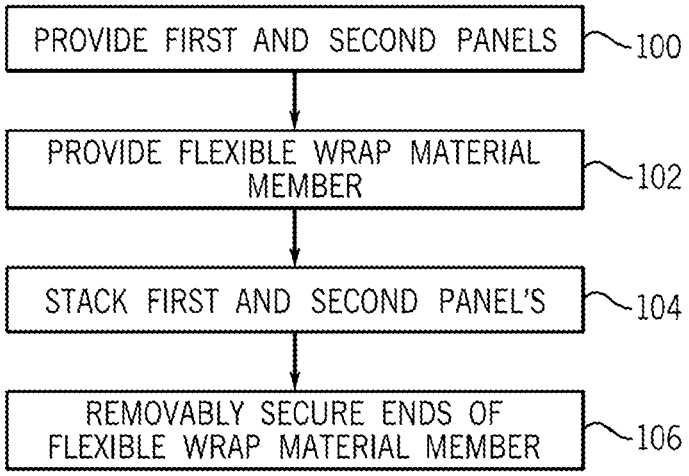
FIG. 6 is a process flow diagram of a wrapping method according to one aspect of the present disclosure.

A wrapping method for a wrap device of a modular panel system will now be described. In particular, the wrapping method shown in FIG. 6 can be used for the wrap device 50 of the modular panel system 10 as described herein, though this is not required and the method could be used with other wrapping devices and/or modular panel systems. As shown, at 100, the method includes providing at least the first and second panel members 12, 14, which are adapted to be removably connected together to form a predefined assembly in an assembled state, such as the shade chair configuration illustrated in FIG. 1, or stacked together for transport in a stacked configuration such as shown in FIG. 2. Additionally, providing the panels at 100 can include providing third and fourth panels 16, 18, though this is not required.

At 102, the flexible wrap material member 52 can be provided, wherein the flexible wrap material member is configured to selectively wrap the stacked panels 12, 14, 16, 18 when in the stacked configuration as described hereinabove. At 104, the panels, including at least the first and second panels 12, 14 and optionally additionally including the third and fourth panels 16, 18, are stacked into the stacked configuration. At 106, the flexible wrap material member 52 can be wrapped around the panels, including at least the first and second panels 12*m* 14 and optionally further including the third and fourth panels 16, 18, in the stacked configuration. Specifically, as described hereinabove and best illustrated in FIG. 2, the flexible wrap material member 52 is wrapped about lateral sides of the panels 12, 14, 16, 18. Optionally, the method can further include removably securing longitudinal ends 52*a*, 52*b* of the flexible wrap material member 52 together as described hereinabove to secure the panels, including the first and second panels 12, 14 and optionally further including the third and fourth panels 16, 18, in the stacked configuration.

Still further, at 106, the method can include removably connecting distal ends of at least one strap, for example, distal ends 54*a*, 54*b* of the first strap 54 and/or distal ends 56*a*, 56*b* of the second strap 56 to strap attachment features disposed on the flexible wrap material member 52 to enable the at least one strap (e.g., one of straps 54, 56) to be used to carry the panels, including at least the first and second panels 12, 14 and optionally further including the third and fourth panels 16, 18), in the stacked configuration. As already described herein, this can include securing the distal ends 54*a*, 54*b* of the first strap 54 to the eyelet apertures 70, 72 and 74, 76 as shown in FIG. 2 and/or can include attaching the distal ends 56*a*, 56*b* of the second strap 56 to the loop members 58, 60 as shown in FIG. 4.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A wrap device for a modular panel system, the wrap device comprising:

a preconfigured, non-adjustable flexible wrap material member adapted to selectively wrap stacked panels of the modular panel system for securing and carrying the stacked panels, the flexible wrap material member having a longitudinal length precisely sized to extend continuously around an entire perimeter of the stacked panels when in a wrapped configuration such that the flexible material member closely and exactly conforms to the dimensions of the stacked panels without excess material, wherein the flexible wrap material member is dimensioned such that longitudinal ends of the flexible wrap material member abut one another without substantial overlap and are substantially parallel to one another when in the wrapped configuration, with the flexible wrap material member contacting an entire perimeter of the stacked panels;

at least two strap attachment features positioned along the flexible wrap material member at predefined locations; and at least one strap adapted to selectively couple to the at least two strap attachment features for carrying the stacked panels when wrapped.

2. The wrap device of claim 1 wherein the flexible wrap material member includes a securing device positioned adjacent a longitudinal edge of the flexible wrap material member, the securing device being configured to retain the flexible wrap material member in the wrapped configuration independently of the strap attachment features.

3. The wrap device of claim 2 wherein the securing device includes at least one unitary tab integrally formed with and extending from one longitudinal end of the flexible wrap material member, the at least one unitary tab including a securing feature for securing the flexible wrap material member in a wrapped configuration when wrapped around the stacked panels.

4. The wrap device of claim 3 wherein a longitudinal length of the flexible wrap material member substantially matches and corresponds to a wrapping dimension of the stacked panels such that the flexible wrap material member closely conforms to the outer perimeter of the stacked panels when in the wrapped configuration.

5. The wrap device of claim 1 wherein the at least two strap attachment features include:

first and second loop members disposed on the flexible wrap material member, the first and second loop members spaced apart asymmetrically from longitudinal ends of the flexible wrap material member such that, when the flexible material member is in the wrapped configuration about the stacked panels, the loop members are positioned at different relative distances from the lateral edges of the stacked panels and are oriented substantially parallel to major faces of the stacked panels, the first and second loop members respectively positioned adjacent lateral ends of the flexible wrap material member, the at least one strap adapted to have distal ends thereof secured respectively to the first and second loop members for carrying the stacked panels via the at least one strap.

6. The wrap device of claim 5 wherein, in addition to the first and second loop members, the at least two strap attachment features further include:

eyelet apertures disposed respectively at each corner of the flexible wrap material member, and wherein each of the at least one strap includes a latching device disposed at a distal end thereof for selectively securing to the eyelet apertures.

7. The wrap device of claim 1 wherein the at least one strap is a pair of straps having matching longitudinal lengths.

8. The wrap device of claim 1 wherein the at least two strap attachment features include:

eyelet apertures disposed respectively at each corner of the flexible wrap material member on portions of the flexible wrap material member that are parallel to major faces of the stacked panels when in the wrapped configuration, and wherein each of the at least one strap includes a latching device disposed at a distal end thereof for selectively securing to the eyelet apertures.

9. The wrap device of claim 1 wherein the flexible wrap material member is removably securable to the panels of the modular panel system when the panels are in an assembled state in a shade chair configuration.

10. A wrap device in combination with a modular panel system, comprising:

first and second panel members adapted to be removably connected together to form a predefined three-dimensional functional furniture structure in an assembled state wherein the panel members are oriented perpendicular to one another and intersect to create an occupiable functional furniture piece or stacked together for transport in a stacked configuration for transport;

a preconfigured, non-adjustable flexible wrap material member configured to selectively wrap the stacked panels when in the stacked configuration, wherein the flexible wrap material member is dimensioned to circumferentially envelop the first and second panel members in their entirety when in the stacked configuration, the flexible wrap material member including at least two strap attachment features, wherein the flexible wrap material member is dimensioned such that longitudinal ends of the flexible wrap material member abut one another without substantial overlap and are substantially parallel to one another when in the wrapped configuration; and at least one strap adapted to selectively connect to the at least two strap attachment features of the flexible wrap material member.

11. The wrap device of claim 10 wherein the flexible wrap material member includes a securing device distinct from the at least two strap attachment features and positioned along a longitudinal end of the flexible wrap material member, the securing device being configured to retain the flexible wrap material member in a wrapped configuration about the stacked panels independently of the at least two strap attachment features.

12. The wrap device of claim 10 further including third and fourth panel members adapted to be removably connected together with the first and second panels to form the predefined assembly in the assembled state or stacked together with the first and second panels for transport in the stacked configuration, wherein the flexible wrap material member has a longitudinal length that is sized to match a wrapping dimension of the first, second, third and fourth panels when in the stacked configuration, wherein the flexible wrap material member is specifically dimensioned to circumferentially envelop all four panel members when stacked together.

13. The wrap device of claim 12 wherein the flexible wrap material member is removably connectable to lateral sides of the first and fourth panels when the first, second, third and fourth panels are in the assembled state in a shade chair configuration, wherein the first and fourth panels are orthogonally oriented relative to the second and third panels in a rectangular configuration.

14. The wrap device of claim 10 wherein the at least two strap attachment features include:

first and second loop members disposed on the flexible wrap material member to which distal ends of the at least one strap are removable connectable for carrying the first and second panel members in the stacked configuration when the flexible wrap material member is selectively wrapped about the first and second panel members.

15. The wrap device of claim 14 wherein each of the at least one strap includes a carabiner at each of the distal ends for removably connecting the at least one strap to the first and second loop members.

16. The wrap device of claim 14 wherein the at least two strap attachment features include:

eyelet apertures disposed adjacent each respective corner of the flexible wrap material member to which the distal ends of the at least one strap are removable connectable.

17. The wrap device of claim 10 wherein the at least two strap attachment features include eyelet apertures disposed adjacent each respective corner of the flexible wrap material member to which distal ends of the at least one strap are removable connectable, and wherein the at least one strap includes a pair of straps with distal ends of each of the pair of straps removable connectable to adjacent ones of the eyelet apertures when the flexible wrap material member is wrapped about the first and second panels in the stacked configuration so as to extend along a longitudinal extent of the first and second panels.

18. A wrapping method for a wrap device of a modular panel system, the method including:

providing first and second panels adapted to be removably connected together to form a predefined assembly in an assembled state or stacked together for transport in a stacked configuration;

providing a flexible wrap material member having a preconfigured length dimensioned to fully circumferentially envelop the stacked panels when in the stacked configuration and extend continuously around an exterior perimeter of the first and second panels in the stacked configuration;

stacking the first and second panel members into the stacked configuration; and wrapping the flexible wrap material member around the first and second panels in the stacked configuration, wherein the flexible wrap material member extends completely around an exterior perimeter of the stacked panel members closely conforms to the dimensions of the stacked panels and provides full perimeter coverage in the wrapped configuration, wherein the wrapping includes aligning longitudinal ends of the flexible wrap material member such that the longitudinal ends abut one another without substantial overlap and are substantially parallel to one another when in the wrapped configuration, with the flexible material member contacting an entire perimeter of the stacked panels.

19. The wrapping method of claim 18 further including:

removably securing longitudinal ends of the flexible wrap material member together to secure the first and second panels in the stacked configuration.

20. The wrapping method of claim 18 wherein the flexible wrap material member includes at least two strap attachment features and the method further includes:

removably connecting distal ends of at least one strap to strap attachment features disposed on the flexible wrap material member to enable the at least one strap to be used to carry the first and second panels in the stacked configuration.

* * * * *